US005758629A

United States Patent [19]

Bahr et al.

[11] Patent Number: 5,758,629

[45] Date of Patent: Jun. 2, 1998

[54] ELECTRONIC IGNITION SYSTEM FOR INTERNAL COMBUSTION ENGINES AND METHOD FOR CONTROLLING THE SYSTEM

[75] Inventors: Ulrich Bahr, Brunswick; Michael Daetz, Tiddische, both of Germany

[73] Assignee: DAUG Deutsche Automobilgesellschaft mbH, Brunswick, Germany

[21] Appl. No.: 802,889

[22] Filed: Feb. 18, 1997

[30] Foreign Application Priority Data

Feb. 16, 1996 [DE] Germany ..... 196 05 803.1

[51] Int. Cl.[6] ..... F02P 3/12

[52] U.S. Cl. ..... 123/644

[58] Field of Search ..... 123/644, 645, 123/609, 388

[56] References Cited

U.S. PATENT DOCUMENTS

| | | | |
|---|---|---|---|
| 4,380,989 | 4/1983 | Takaki | 123/644 |
| 4,886,037 | 12/1989 | Schleupen | 123/645 |
| 4,915,086 | 4/1990 | Ciliberto et al. | 123/609 |
| 5,293,129 | 3/1994 | Ikeuchi et al. | 324/399 |
| 5,309,888 | 5/1994 | Deutsch et al. | 123/609 |
| 5,446,385 | 8/1995 | Kugler et al. | 324/388 |
| 5,483,818 | 1/1996 | Brandt et al. | 73/35.01 |
| 5,619,975 | 4/1997 | Schmidt et al. | 123/644 |
| 5,623,912 | 4/1997 | Kelly | 123/644 |

FOREIGN PATENT DOCUMENTS

| | | |
|---|---|---|
| 0028528 | 5/1981 | European Pat. Off. . |
| 0260177 | 3/1988 | European Pat. Off. . |
| 2444242 | 4/1975 | Germany . |
| 3006665 | 9/1981 | Germany . |
| 3924985 | 2/1991 | Germany . |
| 4233224 | 4/1993 | Germany . |
| 4239803 | 5/1993 | Germany . |
| 4303267 | 8/1993 | Germany . |
| 19502402 | 8/1995 | Germany . |
| 06299941 | 10/1994 | Japan . |

*Primary Examiner*—Raymond A. Nelli
*Attorney, Agent, or Firm*—W. G. Fasse; W. F. Fasse

[57] ABSTRACT

An electronic ignition system for an internal combustion engine is so controlled that an ignition current or secondary current caused by an ignition spark at the respective spark plug in the secondary coil of an ignition transformer is evaluated for initiating, if necessary, follow-up charges of the primary coil to thereby generate further ignition impulses. The initial loading or charging impulse is provided by a respective control circuit. The total sparking time at the respective spark plug thus corresponds to a sequence of individual impulses, each of which causes an ignition spark. The detection of the ignition current in the secondary coils is performed with an ignition current measuring circuit arrangement connected to the secondary coils. This measuring circuit (SC) generates a signal representing the secondary or ignition current represented as a voltage drop across a measuring resistor ($R_2$). The voltage drop signal is supplied to an evaluating circuit which in turn generates a follow-up loading signal in response to the result of the evaluation of the measured voltage drop signal.

13 Claims, 3 Drawing Sheets

$U_{st}$
A $t_3$
I
$I_{pr}$
B
B'
$t_2$
$U_{30A}$
C
$I_{sek}$
D
$U_{-10mA}$
E
$U_{B/nI}$
F
$U_{E4}$
G
200
400
600
800
1000
1200
t [μs]

2
OT
IC
IB

ELECTRONIC IGNITION SYSTEM FOR INTERNAL COMBUSTION ENGINES AND METHOD FOR CONTROLLING THE SYSTEM

FIELD OF THE INVENTION

The invention relates to an electronic circuit arrangement for an ignition system in internal combustion engines in which each spark plug generates several ignition sparks during an ignition cycle. The invention also relates to a method for controlling the electronic ignition system.

BACKGROUND INFORMATION

In electronic ignition systems with so-called static high voltage distribution, such distribution of the high voltage to the spark plugs of the individual cylinders is not performed by mechanical distribution systems. Instead, the distribution takes place through an ignition coil or transformer, one of which is allocated to each cylinder and each of which is controlled or energized by its respective power supply or energizing stage. It is also known to employ double spark coils as well as quadruple spark coils. The double spark coils serve two cylinders simultaneously, while the quadruple spark coils serve four cylinders simultaneously. The energizing stage for each ignition coil comprises a power switching stage, for example, a Darlington transistor which receives a control impulse from a control circuit for controlling the dwell angle in open loop or closed loop fashion, and for controlling in closed loop fashion the current of the power supply stage for adjusting the ignition voltage, the ignition energy, and the spark duration.

In this connection it is important that particular attention is paid to the value of the ignition energy to be supplied to the engine or rather to the ignition system of the engine. This energy value should be optimal for each working point or operating condition in a work cycle. For example, a large ignition energy must be available in order to assure a positive cold start. Similarly, a large ignition energy must be available when the spark plugs are fouled or dirty in order to assure a positive ignition of the fuel-air mixture in the cylinder. On the other hand, during normal operation a substantially smaller ignition energy is sufficient.

Various ignition systems have been proposed for the purpose of assuring the supply of an optimal ignition energy for each operating point of an engine.

Thus, German Patent Publication DE 3,924,985 Al discloses an electronic ignition system for an internal combustion engine, wherein a train of individual impulses is generated for supplying the optimal ignition energy for each working point during an ignition cycle. Each impulse in the pulse train generates an ignition spark. Simultaneously, a high voltage capacitor ignition device charges the individual ignition coils with high voltage at a precisely defined point of time. In such a system it is possible to control the current amplitude of each individual impulse and the impulse sequence frequency as a function of engine parameters such as the r.p.m., the fuel-air mixture ratio, the applied load, and any knocking. Such control can be performed either in open loop or closed loop fashion.

The just described known ignition system combines several advantages of a so-called programmable transistor ignition system in which the ignition energy can be controlled in closed loop or open loop fashion as a function of operating and environmental parameters while simultaneously achieving the advantage of the high voltage capacitor ignition, namely a precisely timed high voltage charging of the ignition coils. However, such a system requires a substantial effort and expense with regard to structural components including circuit components with the result of high manufacturing costs for such an ignition system.

German Patent Publication DE-OS 2,444,242 discloses an ignition system with a mechanical ignition distributor in which the semiconductor power switch of the power supply stage is triggered by a given switching impulse sequence frequency, whereby the semiconductor switch is switched on and off up to seven times within one ignition cycle. In such a system, for example, an ignition voltage of 3 kV is generated following the first switching of the semiconductor switch. A voltage of 3 kV is sufficient for causing initial ignition. Thereafter, a lower voltage of about 800 V is generated at the spark plug. This lower voltage is required in order to sustain the arc or spark. In such a circuit it is possible to adjust the switching frequency and the switch on duration of the signal that controls the semiconductor switch, in accordance with the requirements of the internal combustion engine. More specifically, the control signal can be adjusted, for example, in response to any one or more parameters such as the temperature of the environment, in response to the atmospheric pressure or in response to the engine temperature or the engine r.p.m. The above described system makes it possible to reduce the size of the ignition coil core, whereby the overall size of the ignition coil can also be reduced. However, the known system has the disadvantage that the selection of the parameters for the adjustment of the pulse duration ratio (on/off ratio) of the signal that controls the semiconductor switch is difficult. These parameters are adjusted depending on the operational parameters of the internal combustion engine or depending on external operating conditions, whereby the parameters do not depend on the current and voltage conditions at the ignition coil. As a result, an actually optimal ignition energy cannot be realized in the above mentioned known system of German Patent Publication DE-OS 2,444,242. An optimal ignition energy in this context is an ignition energy which is just sufficient to ignite the air-fuel mixture. For example, it is necessary in the last mentioned known system to select the switch-on duration in such a way that on the one hand a new ignition is assured in case a previous ignition spark has been extinguished, while on the other hand it is necessary to make do with a shorter charging time at the primary coil in case an ignition spark has not been extinguished. A further disadvantage of the known system relates to the use of a mechanical ignition distributor which is subject to wear and tear.

European Patent Publication EP 0,028,528 Al describes an electronic ignition system with a static high voltage distribution, wherein the semiconductor switch of a power supply stage is controlled by a control unit in response to engine parameters and in response to the primary current flowing through the primary winding of the ignition coil. For this purpose the primary current circuit comprises a load resistor connected in series with the semiconductor power switch. The voltage drop across the load resistor caused by the primary current flow through the load resistor is supplied to a comparator which compares this voltage drop with a reference voltage. The control unit then receives a respective difference signal if the voltage drop across the load resistor exceeds the adjusted reference voltage or value. The loading of the primary winding of the ignition coil is stopped in response to this excess voltage signal signifying that the primary current exceeds a determined value.

The system of European Patent Publication EP 0,028,5928 Al also discloses a sensor in the circuit of the secondary winding of the ignition coil or transformer. This sensor provides a signal indicating the quality of the ignition spark to the control unit. The control unit can, for example, provide from this signal by way of a voltage divider a signal that is proportional to the produced ignition voltage. This proportional signal can then be used to either reduce or increase the primary current to an intended final value, whereby it is possible to supply an optimal ignition energy to the spark plugs, not only depending on the instantaneous operating conditions of the engine, but also depending on the conditions of the ignition system.

U. S. Pat. No. 5,483,818 discloses an ion current measuring circuit requiring two inverting differential amplifiers.

OBJECTS OF THE INVENTION

In view of the above it is the aim of the invention to achieve the following objects singly or in combination:

- to provide a method for controlling and electronic ignition system of internal combustion engines which takes into account operational parameters of the engine as well as the operating status of the ignition system itself in order to optimize the ignition energy supplied to each spark plug;
- to provide an electronic ignition control system which is itself amenable to the above outlined type of control and which can be produced in a cost efficient manner at less effort and expense than was possible heretofore;
- to control the energy content of ignition impulses supplied to a spark plug within an ignition cycle in response to the primary ignition current flowing through primary windings while determining the time sequence of these ignition impulses in response to the secondary current flowing through respective ignition transformer secondary windings;
- to avoid driving the starting time for the individual ignition impulses and their duration from a control unit except for the timing of the ignition cycle sequence; and
- to reduce the size of the ignition transformer to thereby obtain a faster rise time for the primary current which in turn permits realizing short charging times.

SUMMARY OF THE INVENTION

According to the method of the invention the supply of ignition energy impulses to each spark plug is controlled with regard to the energy content of these ignition impulses by control signals provided by the detection and evaluation of the primary current flowing through the primary winding of an ignition transformer while the timed sequence of these impulses is controlled by the detection and evaluation of the secondary current flowing through the secondary winding of the ignition transformer or transformers, whereby the ignition energy supplied to each spark plug is kept at an optimal value with reference to operating parameters including engine parameters and with reference to the operational condition of the ignition system itself. The duration of each ignition cycle is determined by a control or central processing unit in response to operational parameters, such as engine parameters and environmental parameters. This concept provides a simple method because now the control unit is no longer required to determine the points of time for the beginning of the individual ignition impulses nor the time durations for the charging of the primary transformer winding. The control unit or central processing unit only determines the initiation and duration of each ignition cycle.

More specifically, according to the method of the invention a plurality of ignition sparks are produced during an ignition cycle by supplying a starting impulse to the power supply stage from a control unit, whereby the initial charging of the primary coil or winding of the ignition transformer is initiated and stopped when the primary current exceeds a predetermined threshold value. During the remaining time duration of the respective ignition cycle further charging operations are initiated and performed after the secondary current in the secondary winding of the ignition transformer stops flowing following a preceding ignition impulse. Each of the follow-up charges following the first charge is also stopped when the respective primary current reaches a predetermined value.

For purposes of the present control method the ignition coil or ignition transformer in the present system no longer needs to be dimensioned for the entire ignition energy. Rather, the coil volume can be made smaller in accordance with the value of an energy package so to speak that is exactly tailored to the instantaneous requirements of the ignition system. As a result, the smaller coil permits more rapid rise times (di/dt) for the primary current so that short charging times have been realized according to the invention, for example, charging times of about 200 microseconds.

The ignition system according to the invention is characterized in that a bypass or shunt circuit also referred to as diverting circuit for detecting the ignition current, namely the secondary current flowing through the secondary ignition windings, is connected to the secondary windings. The diverting circuit comprises a series connection of a semiconductor diode and a shunt or diverting resistor which produces a voltage drop proportional to the ignition current. This voltage drop is supplied as an ignition current representing signal to an evaluating circuit for the ignition current signal. The evaluating circuit is preferably a threshold value circuit that produces a first follow-up charge control signal in response to the stopping of the ignition or secondary current flow through the secondary winding of the ignition transformer.

According to a further embodiment of the invention the primary current flowing through the primary winding of the ignition transformer is detected by a measuring resistor through which the primary current flows. The voltage drop across this measuring resistor is proportional to the primary current and is supplied to a primary current evaluating circuit which preferably also comprises a threshold value circuit which stops the charging operation when the value of the primary current exceeds a predetermined value and which provides with a time delay a second follow-up charge signal when the primary current has again dropped below the determined value.

According to a further advantageous embodiment of the invention, the first and second follow-up charge control signals are supplied to an AND-gate which produces a control signal for the power output stage, whereby the charging operations are stopped or follow-up charges are initiated respectively.

According to a still further advantageous embodiment of the invention the time duration of an ignition cycle is predetermined by a cycle signal generated by the control unit and supplied to the above mentioned AND-gate.

In yet another preferred embodiment of the invention a differential amplifier is connected in parallel to the bypass or diverting circuit. The differential amplifier functions as an inverter and produces an ion current signal which is supplied to a respective ion current evaluation circuit. The differential amplifier is connected with one of its input to a reference voltage which is applied to the secondary ignition winding between ignition or sparking phases to cause an ion current to flow through a resistor connected in parallel to a differential amplifier for producing a voltage drop proportional to the ion current. The voltage drop signal representing the just mentioned ion current is supplied to an evaluating circuit having an output connected to the central processing or control unit.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
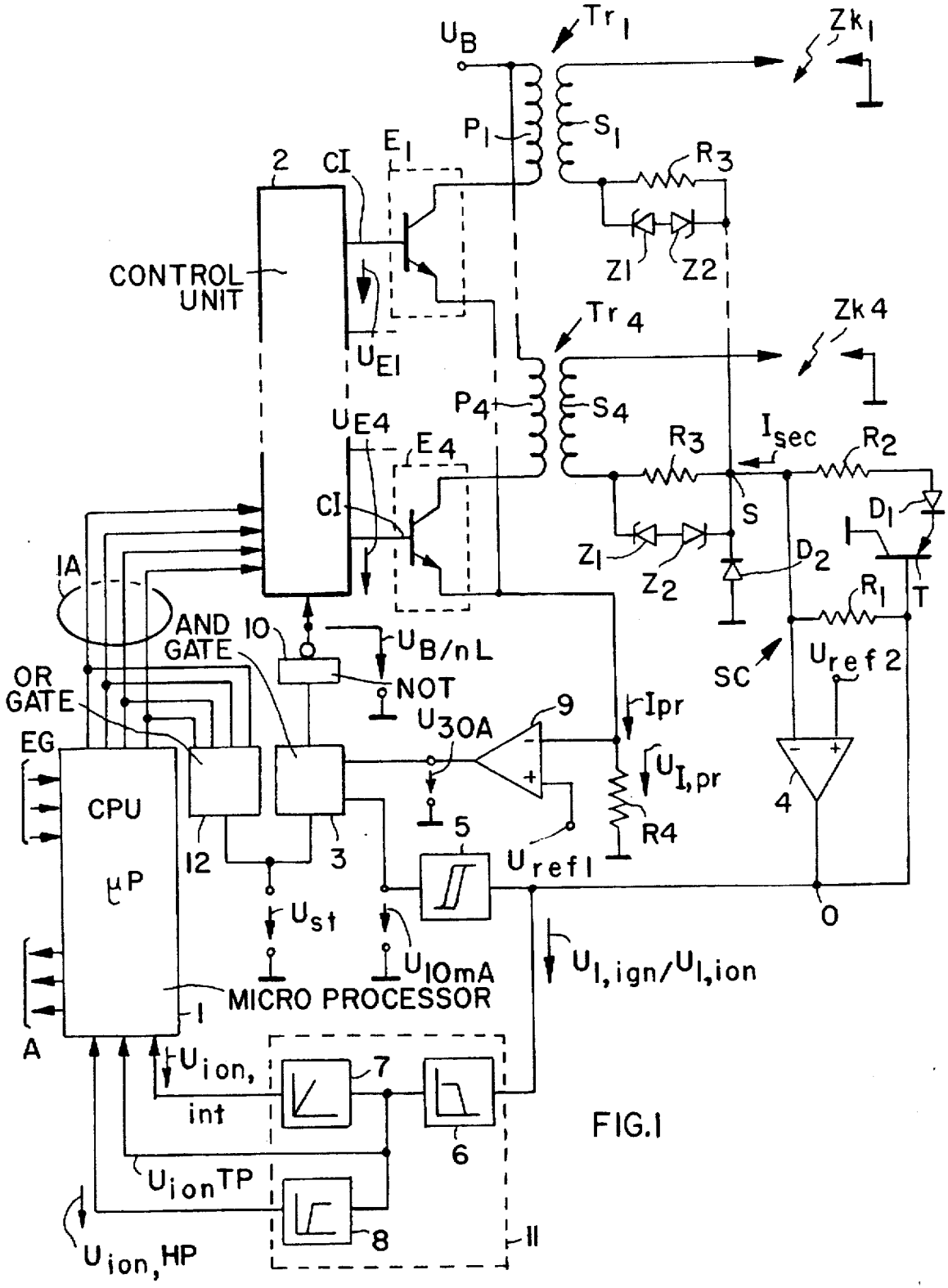
FIG. 1 is a circuit diagram of an electronic ignition system according to the invention for a four cylinder engine having four spark plugs, only two of which are shown.

FIG. 1 shows an electronic transistor ignition system for a four cylinder internal combustion engine. The ignition circuit comprises one ignition stage for each cylinder, whereby only two stages are shown for simplicity's sake since these stages are identical to each other. Each stage energizes one spark plug $Zk_1 \ldots Zk_4$.

Each ignition stage comprises an ignition coil or ignition transformer $Tr_1 \ldots Tr_4$ with a primary coil $P_1 \ldots P_4$ and with a secondary coil $S_1 \ldots S_4$ connected to one electrode of the respective spark plug $Zk_1 \ldots Zk_4$, the other electrode of which is grounded. The respective primary winding $P_1$, $P_4$ are connected to their power supply stages $E_1 \ldots E_4$ which are constructed as semiconductor power switches. Each primary winding $P_1 \ldots P_4$ is connected with one end to an onboard battery providing a battery voltage $U_B$ of, for example 12 V. The other end of the primary windings is connected to the respective power supply stage $E_1 \ldots E_4$ preferably constructed as controllable ignition transistor power switches. The control inputs of these power transistor switches are connected to a respective output of a closed loop control circuit 2 which generates ignition impulses $U_{E1} \ldots U_{E4}$ applied to the respective control inputs CI. The closed loop control circuit 2 distributes the ignition impulses $U_{E1} \ldots U_{E4}$ onto the respective control inputs CI of the ignition power transistors. The emitters of the power transistors $E_1 \ldots E_4$ are grounded through a primary current measuring resistor $R_4$ which leads the primary current $I_{pr}$ to ground and provides a voltage drop $U_{Ipr}$ which provides a voltage signal proportional to the primary current. This proportional signal is processed as will be described in more detail below.

The low voltage ends of the secondary windings $S_1 \ldots S_4$ are connected to a common circuit point S preferably through respective dissipation resistors $R_3$ to be described in more detail below. The high voltage ends of the secondary windings $S_1 \ldots S_4$ of the transformers $T_{r1} \ldots T_{r4}$ are connected to the respective spark plugs $Z_{k1} \ldots Z_{k4}$.

According to the invention a diverting or shunting circuit SC is connected to the common circuit point S. The circuit SC comprises two sections. One section includes an inverting amplifier 4 and a feedback resistor $R_1$ coupling the amplifier output to the inverting input thereof, for producing an ion current signal representing an ion current flow in the cylinder between ignition or sparking phases of an ignition cycle. The inverting amplifier 4 is also a differential amplifier. The other section of the diverting circuit SC comprises a resistor $R_2$ for measuring the secondary or ignition current $I_{sec}$ as a voltage drop across the resistor $R_2$. The ignition current measuring resistor $R_2$ is connected in series between the point S and a semiconductor diode $D_1$ which in turn is connected to ground through the emitter collector circuit of a controllable transistor T. The above mentioned feedback resistor $R_1$ connects the base of the transistor T and the output 0 of the differential amplifier 4 to the inverting input (−) of the differential amplifier 4, whereby the base of the transistor T is also connected to the output 0 of the differential amplifier 4. The other non-inverting input (+) of the differential amplifier 4 is connected to a constant reference voltage $U_{ref2}$.

The circuit SC provides at the output 0 of the differential amplifier 4 output voltages which represent different currents at different times. The voltage signal $U_{I\ ign}$ is representative of the ignition current $I_{ign}$ flowing in the secondary windings $S_1 \ldots S_4$ during an ignition phase when a spark plug is sparking. The voltage signal $U_{I\ ion}$ is representative of an ion current flowing in the combustion chamber between ignition phases in response to an ion measuring voltage or test voltage applied to the spark gaps of the spark plugs $Z_{k1} \ldots Z_{k4}$ forming an ion current path between ignition phases. The constant reference voltage $U_{ref2}$ preferably 5 V, is applied to the non-inverting input (−) of the differential amplifier 4 by a constant voltage source not shown. This constant voltage is supplied by the differential amplifier 4 to the point S and thus to the secondary windings $S_1 \ldots S_2$ and to the spark plugs $Z_{k1} \ldots Z_{k4}$.

A grounding circuit comprising a second semiconductor diode $D_2$ is connected between ground and the point S for dissipating any negative voltage peaks that occur at the moment when a high voltage sparking begins at any one of the spark plugs $Z_{k1} \ldots Z_{k4}$.

The ignition or secondary current $I_{sec}$ derived through the series circuit comprising the resistor 2, the semiconductor diode $D_1$ and the collector emitter circuit of the transistor $T_2$. The transistor T is used in the just mentioned series circuit only for the purpose of increasing the current loadability of the differential amplifier 4 or to prevent overloading of the amplifier 4. It is, however, possible to omit the transistor T altogether. In that case, the cathode of the semiconductor diode $D_1$ is directly connected to the output of the differential amplifier 4, whereby the series circuit of the resistor 2 and the semiconductor diode $D_1$ is directly connected in parallel to the ion current measuring and feedback resistor $R_1$ and thus directly with the output 0 of the differential amplifier 4.

Figure 4:
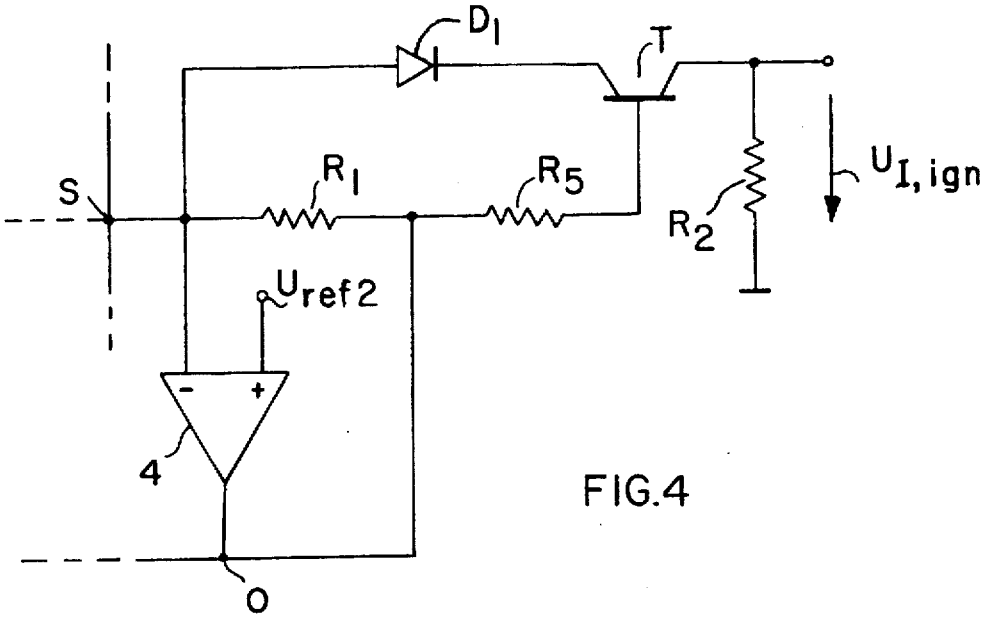
FIG. 4 illustrates a modification of the bypass or diverting circuit of FIG. 1.

In another modification shown in FIG. 4 the ignition current measuring resistor $R_2$ is not connected to the emitter circuit of the transistor T, but rather to the collector circuit, whereby the measured signal $U_{Iign}$ is measured relative to ground potential which is advantageous with regard to the further processing of this measured signal. A further resistor $R_5$ connected to the base of the transistor T in FIG. 4 makes sure that any measuring error caused by the base current of the transistor T is limited to acceptably small values.

Referring further to FIG. 1, the primary current Ipr is detected by a voltage drop $U_{Ipr}$ across the above mentioned primary current measuring resistor $R_4$ which is connected in series with each primary winding $P_1 \ldots P_4$ and the respective power transistor $E_1 \ldots E_4$, whereby one end of the resistor $R_4$ is connected to the inverting input (−) of a comparator 9 while the non-inverting input (+) of the comparator 9 is connected to a further reference voltage $U_{ref1}$. The size or value of this further reference voltage $U_{ref1}$ is so selected that the output of the comparator 9 provides a high signal $U_{30A}$ as long as the value of the primary current $I_{pr}$ is smaller than 30 A. The high signal $U_{30A}$ available at the output of the comparator 9 is supplied to one input of an AND-gate 3, the output of which is connected to a control input of the closed loop control circuit 2.

The secondary or ignition current signal representing voltage $U_{Iign}$ is supplied to an input of a threshold circuit 5 for evaluating the ignition current $I_{ign}$. The evaluation circuit 5 produces a first charging signal $U_{Isec}$ as a high signal when the value of the secondary current $I_{ign}$ exceeds −10 mA. This value is relatively speaking approximately zero. The respective ignition current representing signal $U_{Iign}$ is supplied to the other input of the AND-gate 3.

The other signal $U_{Iion}$ representing the ion current $I_{ion}$ also available at the output 0 of the differential amplifier 4 is evaluated subsequent to a sparking or ignition phase in an ion current evaluating circuit 11, wherein the signal $U_{Iion}$ first passes through a low-pass filter 6 which provides at its output a signal $U_{IonTP}$ that is directly fed to a respective input of a further control circuit 1 comprising a microprocessor forming a central processing unit. Additionally, the signal $U_{IonTP}$ is supplied to an integrator circuit 7 and to a high-pass filter 8. The output signal $U_{Ion,int}$ of the integrator 7 is supplied to a respective input of the control circuit 1. Similarly, the output signal $U_{IonHP}$ from the high-pass filter 8 is supplied to a respective input of the control circuit 1. The output signal $U_{IonTP}$ from the low-pass filter 6 is evaluated in the control circuit 1 by the microprocessor to ascertain whether an ignition and a respective combustion have taken place at all. The integrator 7, which is reset prior to each measurement, integrates the ion current representing output signal $u_{IonTP}$ from the low-pass filter 6 and the integrated signal $U_{Ion,int}$ is supplied to the control unit 1 for detecting ignition failures. The signal $U_{IonHP}$ at the output of the high-pass filter 8 is evaluated to ascertain information regarding any engine knocking. The high-pass filter 8 has preferably a limit frequency of 5 kHz.

The open loop control unit 1 performs the function of a so-called engine management, whereby ignition signals are supplied through four conductors 1A to respective inputs of the closed loop control circuit 2. The closed loop control circuit 2 generates ignition impulses $U_{E1} \ldots U_{E4}$ for controlling the power supply stages or switches $E_1 \ldots E_4$. The generation of the ignition impulses takes into account ignition signals on the output conductors 1A from the control unit 1 and a control signal $U_{B/nL}$ coming from the AND-gate 3 through a NOT-gate 10 acting as a negator. The ignition impulses $U_{E1} \ldots U_{E4}$ are supplied to the control input CI of the power switches $E_1 \ldots E_4$. Further, the generation of the ignition signals on the conductors 1A depends on motor or environmental parameters supplied to the control unit 1 at its inputs E. These inputs receive information signals representing the engine load, the r.p.m., the temperature or the like. Respective actuators or sensors are controlled through the outputs A of the control unit 1.

An OR-gate 12 is connected with its inputs to the outputs 1A of the control unit 1. The OR-gate 12 provides an ignition cycle signal $U_{st}$ which is controlling the AND-gate 3 to determine the duration of each ignition cycle.

Figure 2:
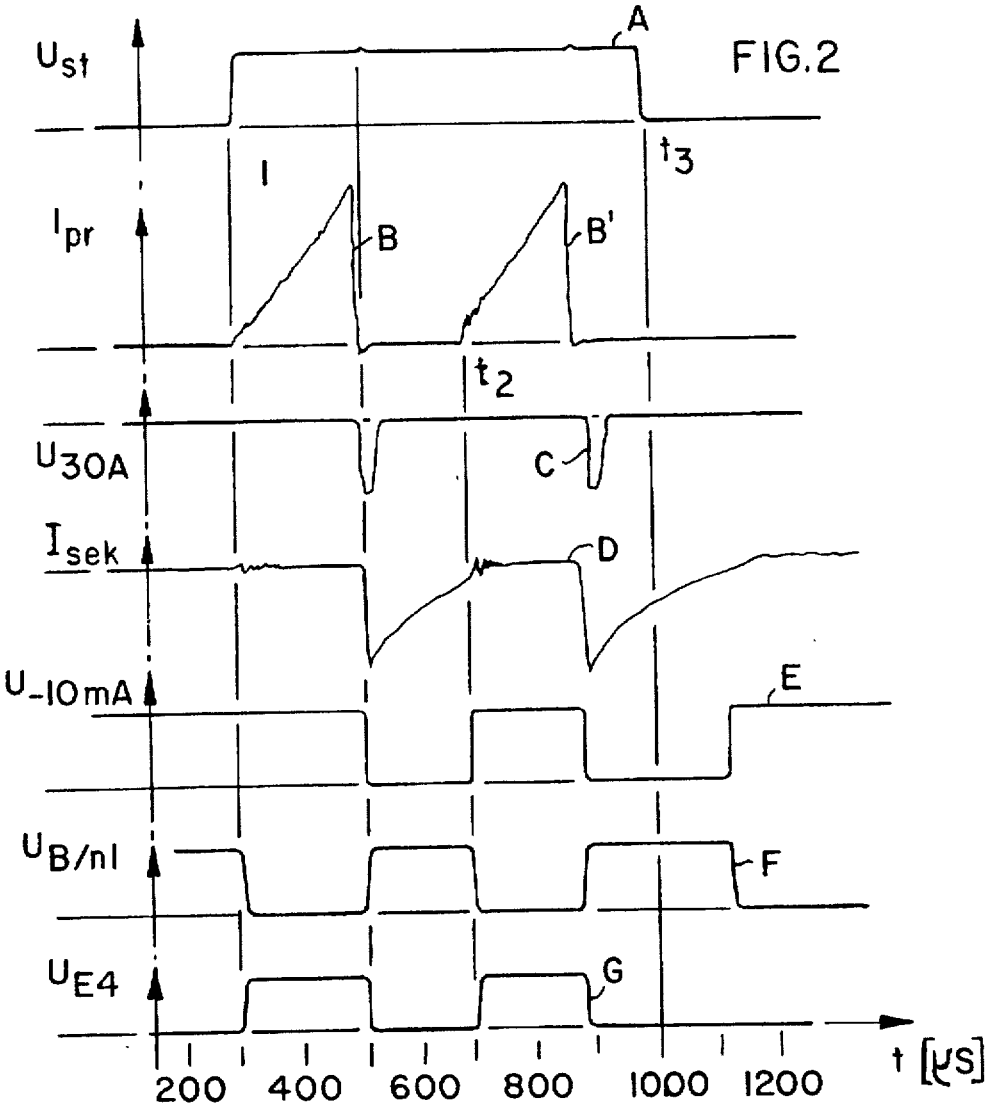
FIG. 2 shows over a common time line along the ordinate several voltage and current impulses or pulse trains as they occur in the operation of the circuit according to FIG. 1.
Figure 3:
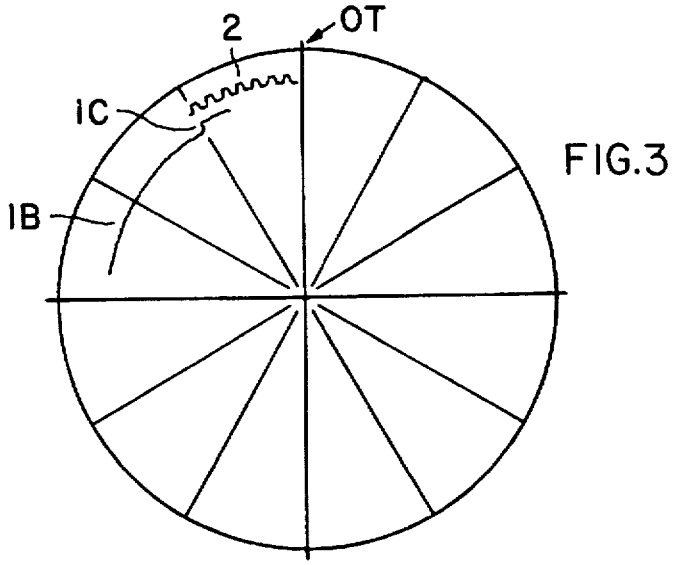
FIG. 3 illustrates a polar diagram for showing the loading time and the sparking duration times of the present electronic ignition system compared to an ignition system according to the prior art relative to a 360° revolution of the crankshaft.

Referring to FIGS. 2 and 3, the operation of the ignition circuit according to FIG. 1 will now be described.

An ignition cycle duration is determined by the ignition cycle signal $U_{st}$ shown as an impulse A in FIG. 2. During the duration of the impulse A from $t_1 \ldots t_3$ several individual impulses forming a pulse train 2 shown in FIG. 3 are generated. Such a pulse train 2 defines the sequence of loading phases and sparking phases within an ignition cycle viewing the polar illustration of FIG. 3 clockwise. FIG. 3 shows an operating point of the internal combustion engine having an r.p.m. of 2000/min wherein the shown cycle begins 30° prior to the upper dead point OT. The duration of the peaks (having a larger radius) of the pulse train 2 in FIG. 3 corresponds to a sparking or ignition phase while the duration of the valleys (having a smaller radius) of the pulse train 2 corresponds to the duration of a loading phase. FIG. 3 also shows a conventional phase distribution, whereby the loading phase 1B starts about 90° prior to the upper dead point OT while the sparking phase 1C starts at 30° prior to the upper dead point OT, but ends already 20° prior to the upper dead point OT. Contrary thereto according to the invention, the loading phases and the sparking phases continue up to the upper dead point OT as shown by the pulse train 2.

Referring further to FIG. 2, an ignition cycle comprising loading and sparking phases begins at the point of time $t_1$ providing a first loading phase B of the respective primary coil. The further course of the loading and sparking phases is determined by the level of the primary current signal $U_{30A}$ and by the first follow-up loading signal $U_{-10mA}$. These signals $U_{30A}$ and $U_{-10mA}$ are processed by the AND-gate 3 and the NOT-gate 10 connected between the output of the AND-gate 3 and a respective control input of the control circuit 2. The signal $U_{30A}$ is shown at C in FIG. 2. The signal $U_{-10mA}$ is shown at E in FIG. 2. The signal $U_{B/nL}$ is shown at F in FIG. 2. If the value of the primary current $I_{pr}$ rises to a value larger than 30A, the comparator 9 lowers the high signal $U_{30A}$ to the low level, please refer to curve C in FIG. 2, whereby the AND-gate 3 causes the control circuit 2 to terminate the charging phase at the respective power stage $E_1 \ldots E_4$. According to curve D in FIG. 2, a secondary current Isec is produced in response to the falling flank of the primary current $I_{pr}$. This secondary current flows as an ignition current in the respective secondary coil $S_1 \ldots S_4$ as viewed from the circuit point S. At this time the size of this ignition current $I_{sec}$ or $I_{ign}$ is smaller than −10 mA, whereby at the output of the threshold circuit 5, the first loading signal $U_{-10mA}$ is set back to the low level, please see curve E in FIG. 2. Since the primary current Ipr at this point of time is below 30A, the primary current signal $U_{30A}$ assumes again the high level following a time delay of a few μs as illustrated by curve C in FIG. 2. In the further course of the sparking phase or ignition phase the secondary current $I_{sec}$ declines again to reach a value above −10 mA. When this value is exceeded the second charging or loading signal again assumes its high level so that all input levels to the AND-gate 3 are at the high level, whereby at the point of time $t_2$ a second loading phase begins as shown by curve B of FIG. 2. This second loading phase is again terminated when the primary current $I_{pr}$ exceeds the value of 30A. During the following sparking or ignition phase, the point of time $t_3$ is exceeded, whereby the ignition cycling signal $U_{st}$ returns to the low level as shown at A in FIG. 2. At this point following the last sparking phase no further loading phase is started.

Pulse train G in FIG. 2 shows the course of the ignition signal flank of the ignition signal $U_{E4}$ is determined by the level of the output signal $U_{BlnL}$ at the output of the NOT-gate 10. Thus, the rising flank is determined either by the rising flank of the ignition cycle signal $U_{st}$ or by the first loading signal $U_{-10mA}$ while the falling flank of the ignition signal $U_{E4}$ is determined by the falling flank of the primary current signal $U_{30A}$.

The duration of an ignition cycle is determined in the control unit 1 on the basis of the operating parameters supplied to the inputs EG of the processing unit 1 and on the basis of the evaluation of the ion current representing signal $U_{lion}$ in the circuit 11 which supplies the respective three inputs $U_{ion,int}$; $U_{ionTP}$; and $U_{ionHP}$. On the basis of these signals, which represent combustion conditions currently prevailing in the combustion chamber of a cylinder, the duration of an ignition cycle is at least 2 milliseconds and may have any desired duration. Thus, the ignition energy supplied to the spark plugs $Z_{k1} \ldots Z_{k4}$ is optimized not only with regard to the actual operating parameters of the engine, but also with regard to the operating conditions currently prevailing at the ignition coils and in the combustion chambers. Since these operating parameters at the ignition coils take into account the primary current as well as the secondary current, one can refer to the present system as a system that provides an energy controlled ignition.

The circuit section SC that measures the ion current and the secondary current by providing respective voltage drops has the advantage that a measuring voltage of less than 40 V is required. Thus, it is possible to generate the measuring voltage and to perform the ion current evaluation with cost efficient low voltage circuit components permitting a simple performance of these tasks. Due to the circuit arrangement of the invention it is possible to use normal semiconductor diodes for the ascertaining of the ignition or secondary currents. These normal semiconductor diodes have substantially smaller leakage currents than conventionally used Zener diodes. Referring again to FIG. 1, the above mentioned dissipation resistor $R_3$ is connected between the point S and the low potential end of each of the secondary coils $S_1 \ldots S_4$. Two Zener diodes $Z_1$ and $Z_2$ connected to each other in an anti-series fashion or in opposing fashion are connected in parallel to each dissipation resistor $R_3$. These parallel circuits are connected to point S which is grounded through a diode $D_2$. These parallel circuits quickly dissipate any remainder energy which at the end of a sparking phase when the spark is extinguished may still be present in the secondary winding and/or in any secondary capacities. Such a parallel circuit of the resistor $R_3$ with the series circuit of the Zener diodes $Z_1$ and $Z_2$ substantially reduces the duration of the decay following a termination of the ignition spark so that directly after such termination the ion current measurement may be immediately performed without being impaired by any decaying characteristic. The ohmic value of the dissipation resistor $R_3$ is preferably within the range of 10 kΩ to 100 kΩ whereby a rapid dissipation of any remainder energy is assured.

The two Zener diodes $Z_1$ and $Z_2$ limit the voltage drop across the dissipation resistor $R_3$. Such voltage drop would otherwise cause a substantial reduction in the ignition energy without the Zener diodes. For example, an ignition current of 100 mA flowing through a resistor of, for example 50 kΩ would cause a voltage drop of 5000 V. The Zener voltages of the Zener diodes $Z_1$ and $Z_2$ are thus so selected that only a small reduction in the ignition energy is caused by keeping, for example, the voltage drop to not more than 50 V.

Instead of using two Zener diodes $Z_1$ and $Z_2$, it is possible to use but one Zener diode $Z_2$. However, in that case the decaying characteristic would be non-symmetric and the decaying duration would be somewhat longer. However, the use of but one Zener diode has the advantage that the voltage drop during ignition would be smaller than 1 volt.

In both instances the Zener diodes are connected in series to the secondary windings of the ignition coils $T_{r1} \ldots T_{r4}$ and also in series to the ion current measuring resistor $R_1$. As a result, leakage currents do not have any negative effect during the following ion measurement.

After the decaying of the ignition current the reference voltage $U_{ref2}$ which serves as a measuring voltage is applied by the inverting differential amplifier 4 to the secondary windings $S_1 \ldots S_4$ to thereby produce at the respective spark plug $Z_{k1} \ldots Z_{k4}$ an ion current flow.

The inverting differential amplifier 4 converts this ion current into the above mentioned ion current representing signal $U_{I,\,Ion}$ as a voltage drop across the feedback resistor $R_1$. This signal is supplied as a signal proportional to the ion current, to the ion current evaluating unit 11 comprising as mentioned above the low-pass filter 6, the integrator 7, and the high pass filter 8. The measuring voltage $U_{Mes}$ that is supplied to the secondary windings $S_1 \ldots S_4$ of the ignition transformers $Tr_1 \ldots Tr_4$ is kept within the range of 5 to 30 V, preferably at 20 V. This voltage is constant during the duration of the ion current measurement. Since the ion current is in the range of μA, the differential amplifier 4 must be operable with a low input current. Such differential amplifiers are readily available on the market at reasonable costs. By providing the measuring voltage $U_{Mes}$ in a low impedance circuit the recharging of stray capacities is eliminated. Such recharging occurs in conventional systems with alternating current loading, and for example when engine knocking occurs during combustion. This feature of avoiding recharging of stray capacities is an important advantage of the invention since it makes itself noticeable, especially when several ion measuring paths are operated simultaneously as is shown in FIG. 1 for four spark plugs $Zk_1 \ldots Zk_4$, because in such instances the effective stray capacities may be multiplied.

In order to further limit the current flowing through the differential amplifier 4 it is possible to connect a further resistor in series with the inverting input (−) of the differential amplifier 4. Such resistor is not shown in the drawings, however.

The division of functions between the processing unit 1 and the other circuit components described above may also be realized in different ways. For example, it is possible that the control unit 1 takes over further functions, for example, the integration of the ion current signals, thereby avoiding the integrator 7. Similarly, the function of the comparators 5 and 9 and of the AND- function of the AND-gate 3 may be performed in the central processing unit 1. Similarly, or in the alternative, the function of the closed loop control circuit 2 can also be taken up by the central processing unit 1 for triggering the power switches $E_1 \ldots E_4$.

Although the invention has been described with reference to specific example embodiments, it will be appreciated that it is intended to cover all modifications and equivalents within the scope of the appended claims.

What is claimed is:

1. A method for controlling an electronic ignition system for internal combustion engines, comprising the following steps:

(a) generating ignition timing signals for defining ignition cycles, each of which is started by a respective timing signal, (b) generating during each ignition cycle a plurality of ignition sparks applied to a respective spark plug ($Zk_1$ . . . $Zk_4$);

(c) first charging a primary winding ($P_1$ . . . $P_4$) of an ignition transformer, in response to an ignition cycle starting timing signal, (d) sensing a primary current ($I_{pr}$) in said primary winding and stopping said first charging in response to said primary current ($I_{pr}$) exceeding a fixed threshold primary current ($I_{pr}$) value, (e) further repeatedly charging said primary winding during a time period remaining in a respective ignition cycle after a secondary ignition current ($I_{sec}$) has stopped flowing following a preceding charging step, and (f) stopping said further chargings in response to said primary current ($I_{pr}$) reaching respectively a determined primary current value.

2. An apparatus for performing an ignition control in an ignition system of an internal combustion system including an ignition transformer with a charging primary winding and an ignition secondary winding for each spark plug, comprising a diverting circuit arrangement for detecting a secondary ignition current ($I_{sec}$) said diverting circuit arrangement comprising a series circuit of a semiconductor diode ($D_1$) and a measuring resistor ($R_2$) shunting said ignition current ($I_{sec}$) to ground and to provide a voltage drop across said resistor ($R_2$), and including an ignition current evaluating unit (5) connected to receive said voltage drop signal for evaluation to produce a control signal.

3. The circuit arrangement of claim 2, in which said ignition current evaluating unit (5) comprises a threshold value circuit which produces a first follow-up loading signal ($U_{-10mA}$) following termination of the secondary ignition current ($I_{sec}$).

4. The circuit arrangement of claim 2, further comprising a measuring resistance ($R_4$) for the detection of the primary current ($I_{pr}$) through which the primary current flows and causes a proportional voltage drop, and wherein said primary current proportional voltage drop is supplied to a primary current evaluation unit (9) connected with its input to said measuring resistor ($R_4$).

5. The circuit arrangement of claim 4, wherein said primary current evaluation unit (9) comprises a threshold value circuit which terminates a loading operation in response to the primary current exceeding a predetermined value, said threshold value circuit producing with a time delay, a second follow-up loading signal.

6. The circuit arrangement of claim 5, further comprising an AND-gate (3) connected to receive the first and second follow-up loading signals at AND-gate inputs, said AND-gate being connected with its output to a closed loop control circuit (2) for producing a control signal or trigger signal for the power supply stages ($E_1$ . . . $E_4$) of said ignition transformer or transformers.

7. The circuit arrangement of claim 6, wherein a signal representing a duration of an ignition cycle is supplied to said AND-gate (3) through an OR-gate (12) connected with its input to the outputs of a microprocessor which produces an ignition cycle signal ($U_{st}$).

8. The circuit arrangement of claim 2, further comprising an inverting differential amplifier (4) for producing an ion current representing signal ($U_{I,ion}$), said differential amplifier (4) being connected in parallel to the series circuit of said semiconductor diode ($D_1$) and said secondary current measuring resistor ($R_2$), said inverting amplifier (4) having a reference input (+) connected to a preferably constant reference voltage ($U_{ref2}$) serving as an ion measuring voltage.

9. The circuit arrangement of claim 8, wherein the series circuit of said semiconductor diode ($D_1$) and said secondary current measuring resistor ($R_2$) is connected to a semiconductor switch (T) controllable by an output of said differential amplifier (4), said semiconductor switch (T) comprising a transistor connected with one of its terminals to ground potential.

10. The circuit arrangement of claim 9, wherein the secondary current measuring resistor ($R_2$) is connected through the semiconductor diode ($D_1$) to the emitter circuit of said transistor (T).

11. The apparatus of claim 8, wherein said secondary measuring resistor ($R_2$) is connected to the collector circuit of said transistor (FIG. 4).

12. The circuit arrangement of claim 8, further comprising a feedback resistor ($R_1$) connected in parallel to said inverting differential amplifier (4) between an output (O) and an inverting input (–) of said amplifier (4), said feedback resistor ($R_1$) providing a voltage drop proportional to an ion current flowing through said feedback resistor ($R_1$) when said reference voltage is applied between sparking phases during an ion current measuring phase.

13. The circuit arrangement of claim 12, wherein the ion current representing signal ($U_{I,Ion}$) is supplied to an ion evaluating circuit (11), the output of which is connected to a central processing unit (1).

* * * * *

UNITED STATES PATENT AND TRADEMARK OFFICE
CERTIFICATE OF CORRECTION

PATENT NO. : 5,758,629

DATED : June 2, 1998

INVENTOR(S) : Bahr et al.

It is certified that error appears in the above-identified patent and that said Letters Patent is hereby corrected as shown below:

Col. 2, line 67, before "also" replace "5928 A1" by --528 A1--.

Col. 6, line 21, before "of" replace "0" by --O--;
line 23, before "of" replace "0" by --O--;
line 61, before "of" replace "0" by --O--.

Col. 7, line 5, after "current" replace "Ipr" by --$I_{pr}$--;
line 29, before "of" replace "0" by --O--;
line 37, before "of" replace "$U_{lon,nt}$" by --$U_{lon,\ int}$--.

Col. 8, line 48, before "is" replace "Isec" by --$I_{sec}$";
line 55, before "at" replace "Ipr" by --$I_{pr}$--.

Col. 9, line 6, after "signal"/insert --$U_{E4}$ of the respective power stage $E_4$. The rising (first occurrence) and falling--.

Signed and Sealed this

Eighth Day of September, 1998

*Attest:*

Bruce Lehman

BRUCE LEHMAN

*Attesting Officer*

*Commissioner of Patents and Trademarks*